US011851959B2

(12) United States Patent
Sehsah et al.

(10) Patent No.: US 11,851,959 B2
(45) Date of Patent: Dec. 26, 2023

(54) METHOD AND APPARATUS FOR THE EXACT PLACEMENT OF RESIN AND CEMENT PLUGS

(71) Applicant: SAUDI ARABIAN OIL COMPANY, Dhahran (SA)

(72) Inventors: Ossama Sehsah, Dhahran (SA); Amjad Alshaarawi, Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 480 days.

(21) Appl. No.: 16/941,083

(22) Filed: Jul. 28, 2020

(65) Prior Publication Data

US 2022/0034177 A1 Feb. 3, 2022

(51) Int. Cl.

| | |
|---|---|
| ***E21B 21/00*** | (2006.01) |
| ***E21B 23/06*** | (2006.01) |
| ***E21B 43/10*** | (2006.01) |
| ***E21B 47/09*** | (2012.01) |

(52) U.S. Cl.

CPC ..... *E21B 21/003* (2013.01); *E21B 23/06* (2013.01); *E21B 43/10* (2013.01); *E21B 47/09* (2013.01)

(58) Field of Classification Search

CPC ..... E21B 21/003; E21B 23/06; E21B 43/10; E21B 47/09

USPC ..... 703/1

See application file for complete search history.

(56) References Cited

U.S. PATENT DOCUMENTS

| | | | | |
|---|---|---|---|---|
| 5,309,994 | A * | 5/1994 | Douglas | E21B 43/04 166/278 |
| 5,833,001 | A * | 11/1998 | Song | E21B 29/10 166/57 |
| 5,909,769 | A | 6/1999 | Duhon et al. | |
| 6,116,353 | A * | 9/2000 | Leavell | E21B 43/10 175/22 |
| 6,283,209 | B1 * | 9/2001 | Keller | E21B 23/04 166/264 |
| 6,896,063 | B2 * | 5/2005 | Chang | E21B 33/1208 166/135 |
| 8,685,903 | B2 | 4/2014 | Ravi et al. | |
| 2002/0040812 | A1 | 4/2002 | Heying | |

(Continued)

FOREIGN PATENT DOCUMENTS

| | | |
|---|---|---|
| CN | 101718183 A | 6/2010 |
| CN | 106948789 A | 7/2017 |
| WO | 2019158985 A1 | 8/2019 |

OTHER PUBLICATIONS

International Search Report and Written Opinion of the International Searching Authority issued in corresponding International Application No. PCT/US2020/049843, dated Jun. 1, 2021 (18 pages).

*Primary Examiner* — Matthew R Buck

*Assistant Examiner* — Patrick F Lambe

(74) *Attorney, Agent, or Firm* — Osha Bergman Watanabe & Burton LLP

(57) ABSTRACT

A method of plugging a section of a wellbore wall includes sending a plug injection tool to a downhole location proximate the section of the wellbore wall, setting a first seal below the section of the wellbore wall using the plug injection tool, and setting a second seal above the section of the wellbore wall using the plug injection tool. A plugging material is pumped between the first and second seals and held there until it solidifies.

18 Claims, 14 Drawing Sheets

(56) References Cited

U.S. PATENT DOCUMENTS

| | | | | |
|---|---|---|---|---|
| 2011/0162844 | A1* | 7/2011 | Mauth | E21B 33/14 166/285 |
| 2014/0231068 | A1* | 8/2014 | Isaksen | E21B 33/134 166/123 |
| 2015/0267501 | A1* | 9/2015 | Al-Gouhi | E21B 33/12 166/299 |

* cited by examiner

METHOD AND APPARATUS FOR THE EXACT PLACEMENT OF RESIN AND CEMENT PLUGS

BACKGROUND

During the drilling operations of an oil or a gas well, a specially designed fluid (known commonly as drilling "mud") is continuously circulated through the well to help with the drilling operations. FIG. 1 shows an example of drilling fluid circulation 10 through a well 12 during a drilling operation, where the drilling fluid 10 is pumped into the well 12 through the drill string 14 and circulated out of the well 12 through the annulus 16 formed between the well wall and the drill string 14. As the well is drilled, the circulating fluid may carry back cuttings from the drilling to the surface. The drilling fluid may be collected at the surface, reconditioned and reused. In the wellbore, the drilling fluid may also be used to maintain a predetermined hydrostatic pressure on the walls of the well, which in turn prevents undesired influxes of hydrocarbons or other fluids from the well to the surface. The circulation may also maintain the integrity of the wellbore by applying pressure on its walls to prevent the walls from collapsing.

However, drilling fluid may be lost into the formation during drilling, resulting in what is commonly known as "lost circulation." Lost circulation can be brought on by natural or induced causes. Natural causes include situations such as naturally fractured formations or unconsolidated zones. Induced losses occur when the hydrostatic pressure in the well exceeds the fracture gradient of the formation (the maximum pressure at which the formation breaks), and the formation pores break down enough to receive rather than resist the fluid.

Lost circulation is a major cause of lost time or non-productive time (NPT) during drilling and increases the cost of drilling to replace expensive drilling fluid lost into the formation. In addition to NPT and adding more cost to drilling, lost circulation leads to a quick drop of the mud column in the wellbore, which can be a starting point to various drilling problems such as kick and blowout, borehole collapse and/or pipe sticking, leading to side tracking or abandonment of a well.

The drilling industry has developed several techniques to fights losses, including, for example, the use of lost-circulation materials (LCM) to plug fractures, the use of chemicals, and the use of cement. However, one of the main reasons for failure of such methods is placement and activation. For example, chemicals and cement need time to activate and solidify. Conventional methods of sending chemicals or cement to plug a lost circulation zone include designing the fluid parameters to activate or solidify at the predicted time it takes for the chemicals or cement to reach the lost circulation zone. Some chemicals have reaction rates controlled by temperature (temperature-triggered reactions). However, activation may sometimes be off, and when activation or solidification happens at a time-scale longer than it takes for the chemicals or cement to reach the lost circulation zone, they may be lost inside the fractures away from the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to downhole plug injection tools that include a base ring or seat fixed inside a bottom end of a tubular body, at least one flexible tie connected at one end to the base ring and at an opposite end to a tie upper attachment point inside an upper end of the tubular body, and a fabric strip connected to and extending between the base ring and a fabric upper attachment point inside the upper end of the tubular body, wherein the fabric strip is positioned radially between the flexible tie and the tubular body.

In another aspect, embodiments of the present disclosure relate to downhole plug injection tools that include a first sealing element removably attached to a bottom axial end of a tubular body, a second sealing element provided around the tubular body above the first sealing element, and a fabric strip connected to and extending between the first sealing element and the second sealing element, wherein the first sealing element and the tubular body are axially adjacent to each other and coaxially aligned.

In yet another aspect, embodiments relate to methods of plugging a section of a wellbore wall that include sending a plug injection tool to a downhole location proximate the section of the wellbore wall, setting a first seal below the section of the wellbore wall, and setting a second seal above the section of the wellbore wall. A plugging material may be pumped between the first and second seals and held between the first and second seals until it solidifies inside a fabric fixed in between the two seals.

Other aspects and advantages will be apparent from the following description and the appended claims.

DETAILED DESCRIPTION

Figure 1:
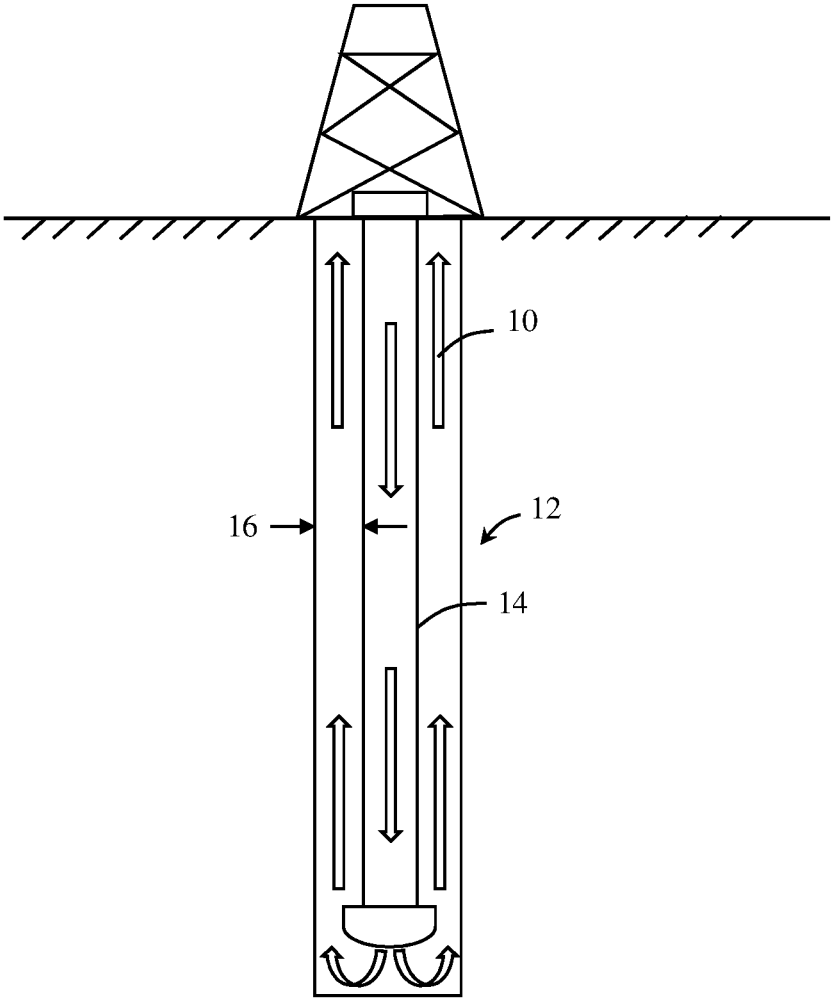
FIG. 1 (Prior Art)
FIG. 1 shows a diagram of a traditional well.

Embodiments disclosed herein relate generally to plugging sections in a wellbore, which may include plugging loss zones determined along the wellbore wall. Downhole tools and methods disclosed herein may include using seals positioned axially above and below a lost circulation zone to hold chemicals and/or cement in the selected location along the wellbore for a period long enough for the chemicals and/or cement to activate or solidify and form a plug at the selected location.

As used herein, the terms "top," "upper," "uppermost," "above," and the like may be used to refer to a direction facing the surface of a well (e.g., a wellhead) from a downhole position, while the terms "bottom," "lower," "lowermost," "below," and the like may be used to refer to a direction facing away from the surface of the well toward the bottom of the wellbore from a downhole position.

Lost circulation may occur when drilling formations with natural or induced fractures, which result in spaces for drilling fluid (e.g., water- or oil-based mud) to flow into, causing a partial or total loss of the drilling fluid. By sealing the area around a lost circulation zone in order to hold a plugging material within the lost circulation zone as it is activated or solidified, the lost circulation zone may be effectively plugged with little or no loss of the plugging material.

Zones of lost circulation may be determined during drilling operations by observing the flow rate of drilling mud returning to surface. More insight can be obtained, for example, by using downhole measurement tools to analyze formation characteristics, such as porosity, pore size, pressure, fracture gradient, and permeability, and/or by using other well analysis tools to monitor parameters of the well, such as pressure and temperature. Well analysis tools may be used to measure and analyze well characteristics during drilling (e.g., by providing downhole measurement tools on the drill string, such as on a bottom hole assembly) and/or in separate logging trips (e.g., by providing downhole measurement tools on a logging tool) into the well. By analyzing characteristics of the well as it is drilled, a location of a lost circulation zone may be determined along a wellbore wall. As used herein, the terms wellbore and borehole may be used interchangeably to refer to an open hole or uncased portion of the well, including the inside diameter of the wellbore wall and the rock face that bounds the drilled hole.

Upon determining the location of a lost circulation zone in a well, a downhole plug injection tool according to embodiments of the present disclosure may be sent in a dedicated trip to the downhole location to seal and plug the lost circulation zone. Downhole plug injection tools according to embodiments of the present disclosure may be sent downhole, for example, with a running tool attached at the end of a drill string.

Plug injection tools of the present disclosure may include two sealing elements, where one of the sealing elements may seal a first axial end of a section of the well containing a lost circulation zone, and the other of the sealing elements may seal a second, opposite, axial end of the section of the well containing the lost circulation zone. Different types of sealing elements may be used to provide the axial seals around a lost circulation zone. Plugging material may be sent down the drill string and into the plug injection tool to provide plugging material between the sealed axial ends of the lost circulation section of the well and held there until the plugging material solidifies.

Further, in some embodiments, fabric may be connected between the two sealing elements to provide a fabric wall extending between the two sealing elements, which when deployed, may at least partially line the borehole wall around the lost circulation zone.

Figure 2:
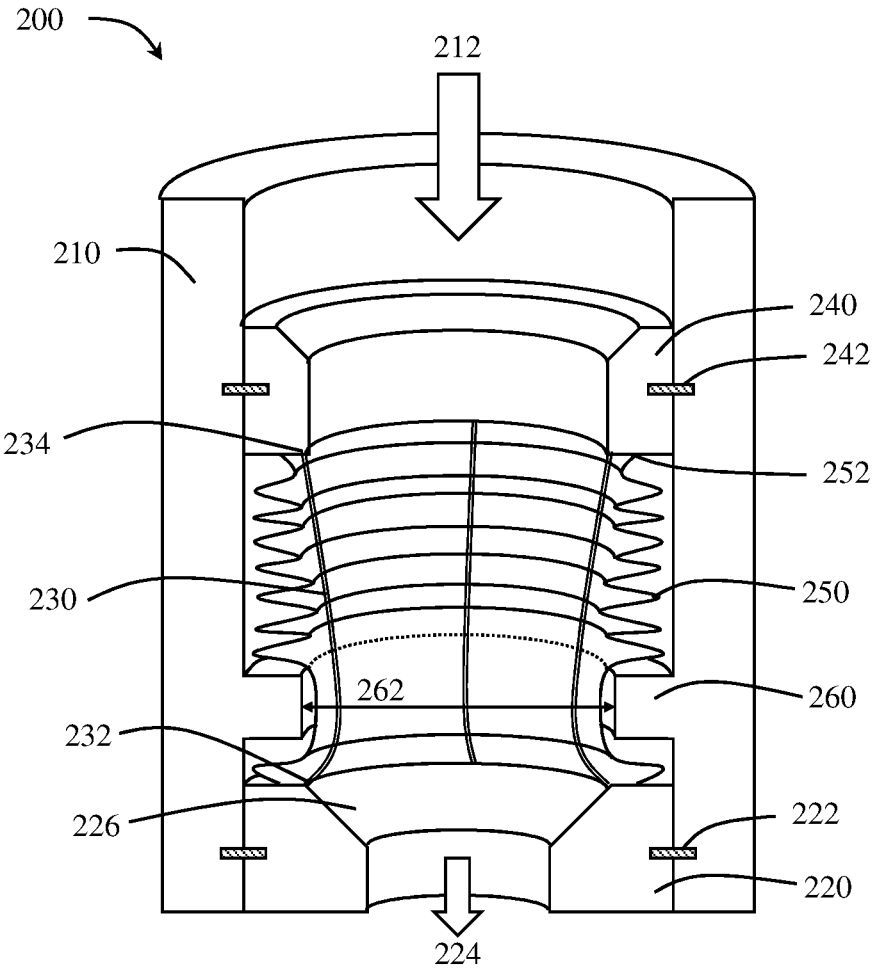
FIG. 2 shows a cross-sectional view of a plug injection tool according to embodiments of the present disclosure.

For example, FIG. 2 shows a cross-sectional view of an example of a plug injection tool 200 according to some embodiments of the present disclosure. The plug injection tool 200 has a generally tubular-shaped body 210 with a flow passage 212 extending axially therethrough. Two sealing elements are provided by sealing/plugging a base ring 220 and a cap ring 240 fixed inside the body 210, where a fabric strip 250 is anchored at axial ends to each of the base ring 220 and cap ring 240.

The base ring 220 may be removably fixed inside a bottom end of the tubular body 210 using, for example, at least one shear pin 222 or an actuated release mechanism. The base ring 220 may extend circumferentially around the entire inner diameter of the tubular body 210 and have a through hole 224 extending through the radial center of the base ring 220. The base ring 220 may further include one or more sloped surfaces forming a base seat 226, which may be used to catch and hold a sealing element (not shown) that is sent through the drill string to plug the base ring 220. The through hole 224 through the base ring 220 may allow continuous circulation of drilling fluid through the well as the drill string and attached plug injection tool 200 are lowered into the well to the lost circulation zone. As described in more detail below, once the plug injection tool 200 is lowered to the selected downhole position proximate the lost circulation zone, a first sealing element (e.g., a ball plug) may be sent through the drill string to land on the base seat 226 and seal/plug the through hole 224 in the base ring 220.

At least one flexible tie 230 may be connected at one end to a lower attachment point 232 on the base ring 220 and at an opposite end to an upper attachment point 234 inside an upper end of the tubular body 210. In the embodiment shown, the upper attachment point 234 is provided on the cap ring 240 fixed inside the upper end of the tubular body 210. The cap ring 240 may be removably fixed inside the upper end of the tubular body 210 using, for example, at least one shear pin 242 or an actuated release mechanism. In other embodiments, the upper attachment point 234 may be provided directly to the inside of the tubular body 210 wall. Flexible ties may include, for example, metal chains, cables, or other length of material flexible enough to be compacted between the lower and upper attachment points 232, 234 and strong enough to hold the sealed base ring 220 after it is detached from the tubular body 210. The flexible ties 230 may be attached at its attachment points, for example, by welding, screw or bolt connections, or other attachment methods known in the art. Further, the flexible ties 230 may have a length selected to hold the base ring 220 a maximum distance from the cap ring 240 when the base ring 220 is detached from the body 210 of the tool 200.

A fabric strip 250 may be connected to and extend between the base ring 220 and an upper attachment point 252 inside the upper end of the tubular body 210. The ends of a fabric strip 250 may be connected to the base ring 220 and fabric attachment point 252 using, for example, screws, fitted connection pieces holding the fabric by interference fit, threaded cap pieces, or other connection methods known in the art. Further, in some embodiments, a weldable fabric type may be used for the fabric strip 250, where welding may be used to maintain non-porous contact points with the base ring 220 and/or the upper attachment point 252.

The fabric strip 250 may be radially positioned between the flexible ties 230 and the tubular body 210 and extend azimuthally around the entire base ring 220. In some embodiments, the fabric strip 250 may extend less than the entire circumferential distance around an upper surface of the base ring 220 (e.g., a distance around the base ring 220 ranging from less than 90 percent, less than 70 percent, or less than 50 percent of the entire distance around the base ring 220). In some embodiments, more than one fabric strip 250 may be positioned around different circumferential locations within the tubular body 210. Further, the fabric strip 250 may have a length that is longer than the flexible ties 230, such that the fabric may expand laterally to the wellbore wall when the flexible ties 230 are holding the base ring 220 at its maximum distance from the cap ring 240.

A fabric strip 250 may be made of a material that is designed to be flexible enough to take the shape of the fractured wellbore, strong enough to not fail due to applied differential pressure between the fluid inside the wellbore and lost circulation zone, and impermeable enough to contain the plugging material (e.g., chemical mixture or cement) from flowing away into fractures through the lost circulation zone. For example, the fabric strip 250 may be a lost circulation fabric (LCF) made of a net-like composite material, such as a woven or non-woven fabric. In some embodiments, the fabric may be formed from a polymeric material, such as a polymer or a fiber-reinforced polymer that is flexible, yet tough and abrasion resistant. For example, LCF may be made of polypropylene or a composite with polypropylene. Polypropylene LCF may be provided, for example, in the form of polypropylene sheets of fabric, or smaller polypropylene strips woven together (e.g., a basketweave fabric). Further, polypropylene LCF may include polypropylene resin mixed with plasticizers, stabilizers, and/or fillers. The LCF may be porous, however the sizing of the pores in the fabric may be such that a lost circulation material (or other plugging material), otherwise lost through a large pore size lost circulation zone, may accumulate on the fabric, forming an impermeable filter cake on the LCF.

In some embodiments, the plug injection tool 200 may also have a seat 260 disposed around an inner surface of the tubular body 210 and positioned axially between the base ring 220 and the cap ring 240, where the seat 260 protrudes radially inward from the inner surface of the tubular body 210. The seat 260 may be integrally formed with the tubular body 210 or may be fixedly attached to the tubular body 210, for example, by welding. The seat 260 may have an inner diameter 262 smaller than the tubular body inner surface. Further, the inner diameter 262 of the seat 260 and the inner diameter of the cap ring 240 may be large enough for a sealing element (not shown) to fit through the cap ring 240 and the seat 260 to land on and seal the base ring 220. Thus, the inner diameter 262 of the seat 260 may be greater than the inner diameter of the base ring through hole 224 and greater than the inner diameter around at least a portion of base seat 226.

In operation, the seat 260 may be used to prevent axial movement of the cap ring 240 below the seat 260, such that once the cap ring 240 is sheared or released from its upper position in the tubular body 210, the cap ring 240 is prevented from falling through the seat 260.

FIGS. 3-8 show operational diagrams of the plug injection tool 200 shown in FIG. 2, as it may be used to seal axially below and above a lost circulation zone 310 in a wellbore 300. According to embodiments of the present disclosure, the plug injection tool 200 may be used to plug a section of a wellbore wall surrounding the lost circulation zone 310 by sending the plug injection tool 200 to a downhole location proximate the section of the wellbore wall, setting a first seal below the section of the wellbore wall using the base ring 220, setting a second seal above the section of the wellbore wall using the cap ring 240, pumping a plugging material between the first and second seals, and holding the plugging material between the first and second seals until it solidifies.

Figure 3:
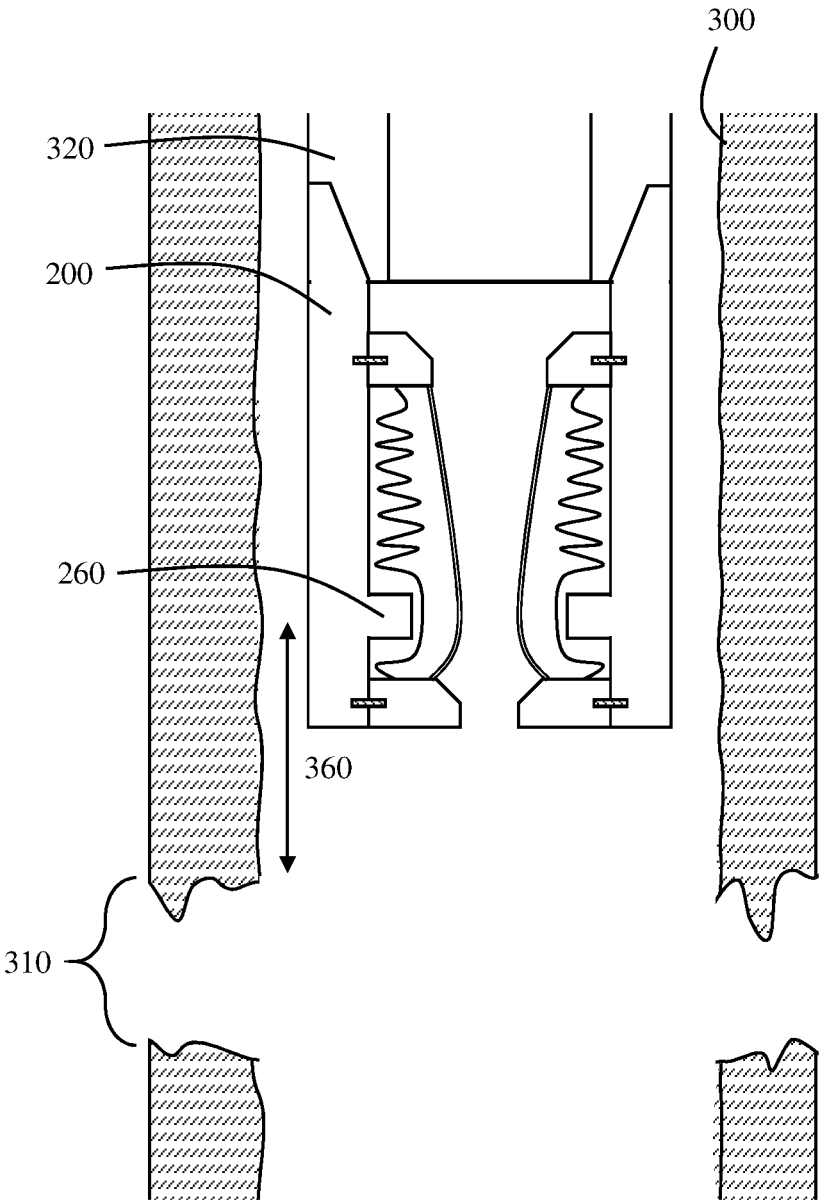
FIGS. 3-8 show operational steps in a method of using the plug injection tool of FIG. 2 according to embodiments of the present disclosure.

As shown in FIG. 3, the plug injection tool 200 may be sent to a downhole position where at least a portion of the tool 200 is axially above the lost circulation zone 310. The plug injection tool 200 may be sent downhole in a dedicated trip on a running tool 320 at the end of a drill string (not shown). According to embodiments of the present disclosure, the plug injection tool 200 may be positioned downhole to where the seat 260 is a distance above the lost circulation zone 310, proximate to a selected upper axial boundary of the section of the wellbore to be sealed.

Figure 4:
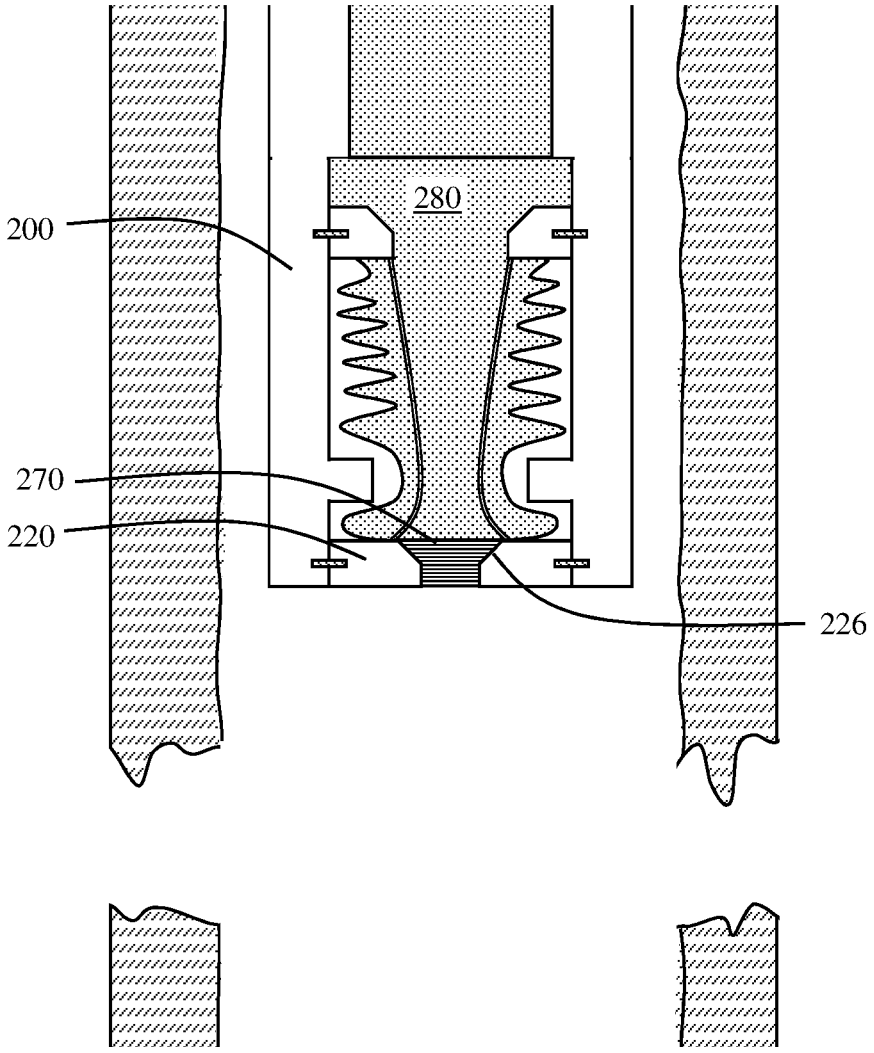

As shown in FIG. 4, a first sealing element 270 may be sent through the drill string and within the plug injection tool 200 to land on the base seat 226, thereby setting a first seal within the through hole in the base ring 220 to seal the base ring 220. The first sealing element may be, for example, a plug or ball having an outer diameter greater than the inner diameter of the through hole in the base ring 220.

Once the base ring 220 is sealed, plugging material 280 may be pumped into a cavity formed by the tubular body 210 and the sealed base ring 220. Suitable plugging material may include, for example, lost circulation material, including fibrous, flake, granular, and/or slurry lost circulation material. A lost circulation slurry may include, for example, a mixture of water and at least one of water soda ash, bentonite, caustic soda, date seeds, marble or other additives. Some lost circulation material may include waste products from food processing or chemical manufacturing industries, such as ground peanut shells, mica, cellophane, walnut shells, calcium carbonate, plant fibers, cottonseed hulls, ground rubber, and polymeric materials. In some embodiments, a plugging material may include a cement which may be designed to harden in the downhole location after a period of time. In some embodiments, a plugging material may include chemicals that are designed to solidify downhole with time or upon an activation sequence.

Figure 5:
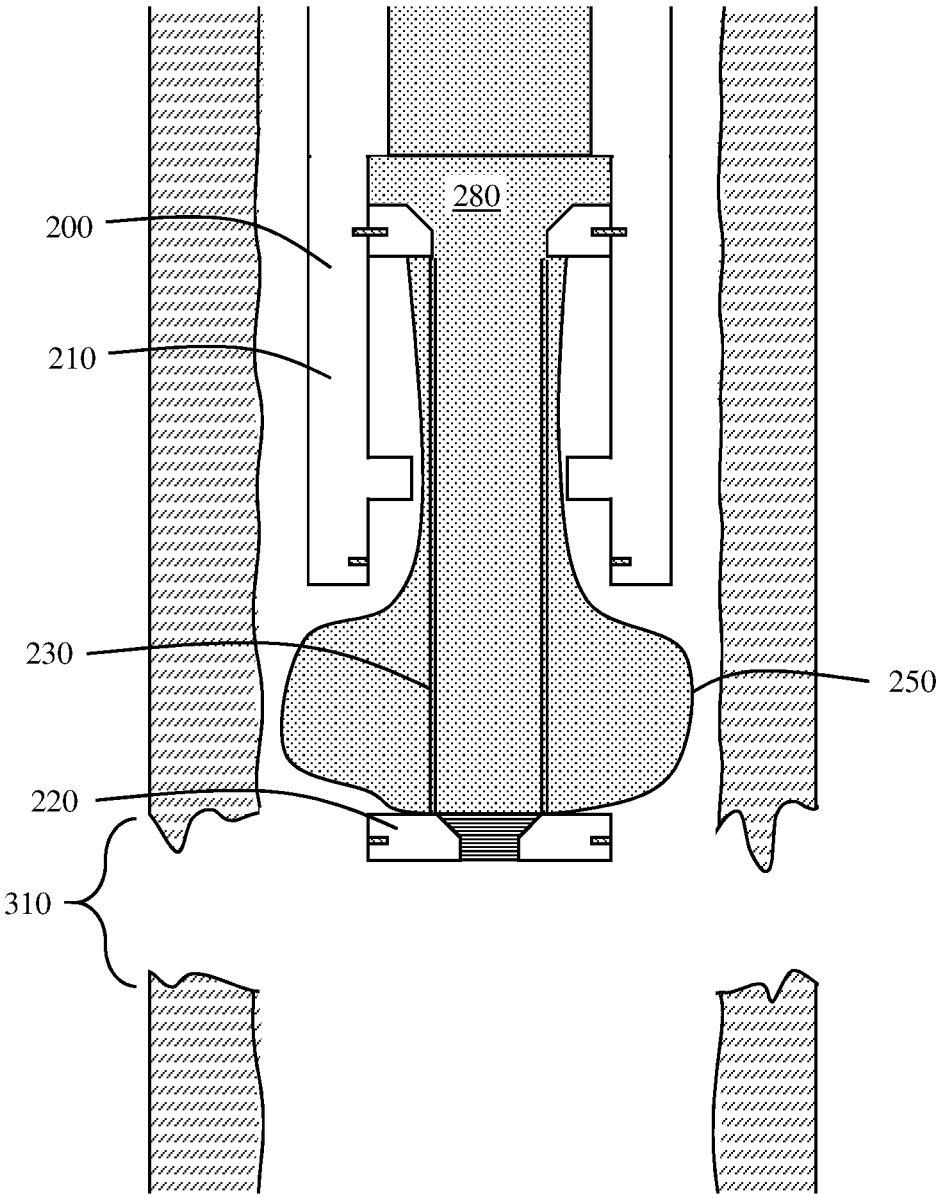

As shown in FIG. 5, the plugging material 280 may be pumped into the plug injection tool 200 until pressure from the plugging material 280 forces the sealed base ring 220 to shear (or otherwise detach) from the tubular body 210. The sheared sealed base ring 220 may remain connected to the tubular body 210 by the flexible ties 230. The flexible ties 230 may have a length that holds the sealed base ring 220 at least partially axially overlapping with the lost circulation zone 310 section of the wellbore. In some embodiments, the flexible ties 230 may have a length that allows the sealed base ring 220 to hang from the plug injection tool 200 below the lost circulation zone 310. For example, depending on the position and proximity of the tubular body 210 to the lost circulation zone 310, the flexible ties 230 may have a length that is up to two times, three times, or four times the axial length of the tubular body 210.

The fabric strip(s) 250 may have a length longer than the flexible ties 230, such that after the sealed base ring 220 is sheared from the tubular body 210, the plugging material 280 may continue to be pumped to fill and expand the fabric strip 250 into the section of the wellbore wall to be sealed. For example, in some embodiments, the fabric strip(s) 250 may have a length that is at least two times the length of the flexible ties 230.

Figure 6:
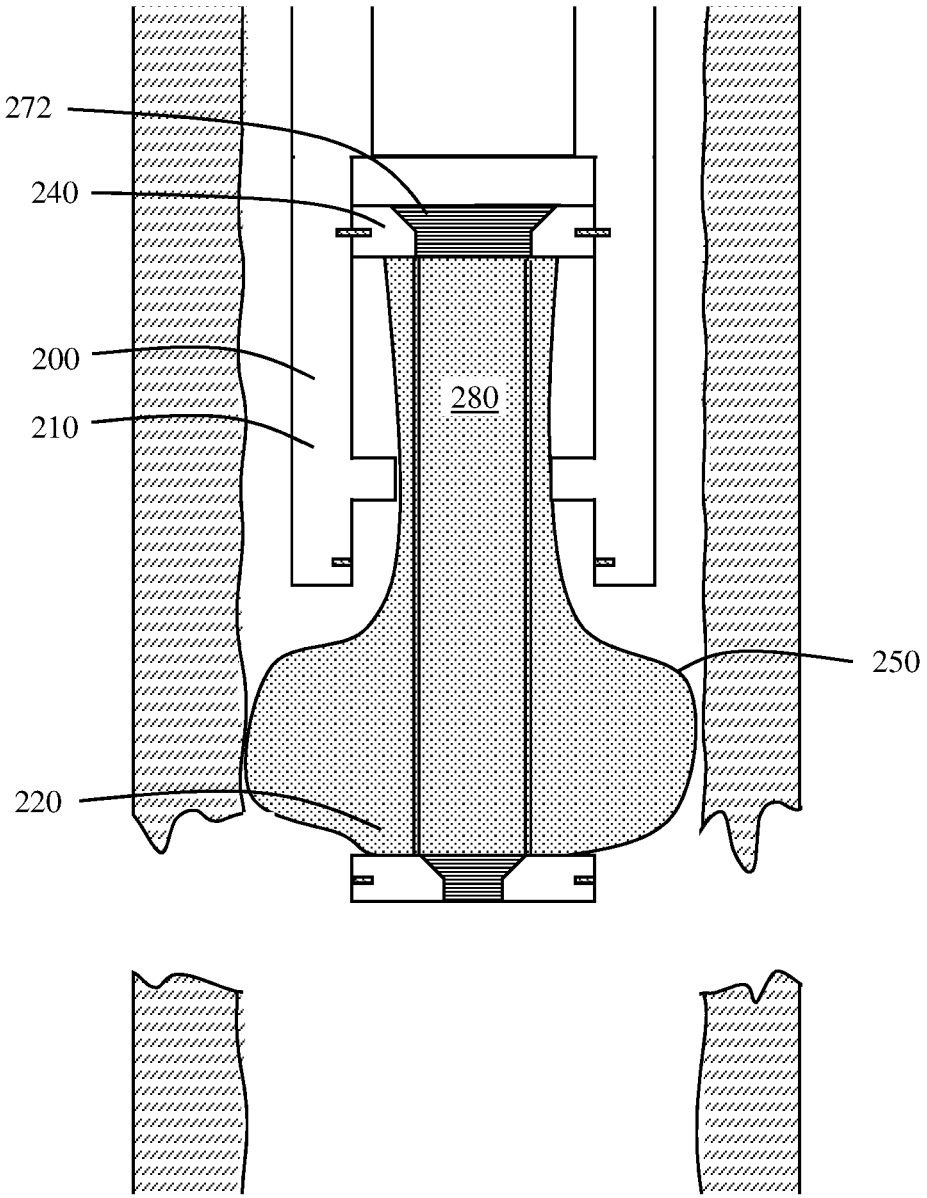

As shown in FIG. 6, after plugging material 280 has been pumped into the plug injection tool 200 at a rate and amount sufficient to shear the sealed base ring 220 from the tubular body 210 and fill or radially expand the fabric strip (s) 250, a second sealing element 272 may be sent through the drill string to land on and plug a through hole formed through the cap ring 240, thereby setting a second seal within the through hole in the cap ring 240. The second sealing element may be, for example, a plug or ball having an outer diameter greater than the inner diameter of the through hole in the cap ring 240.

Figure 7:
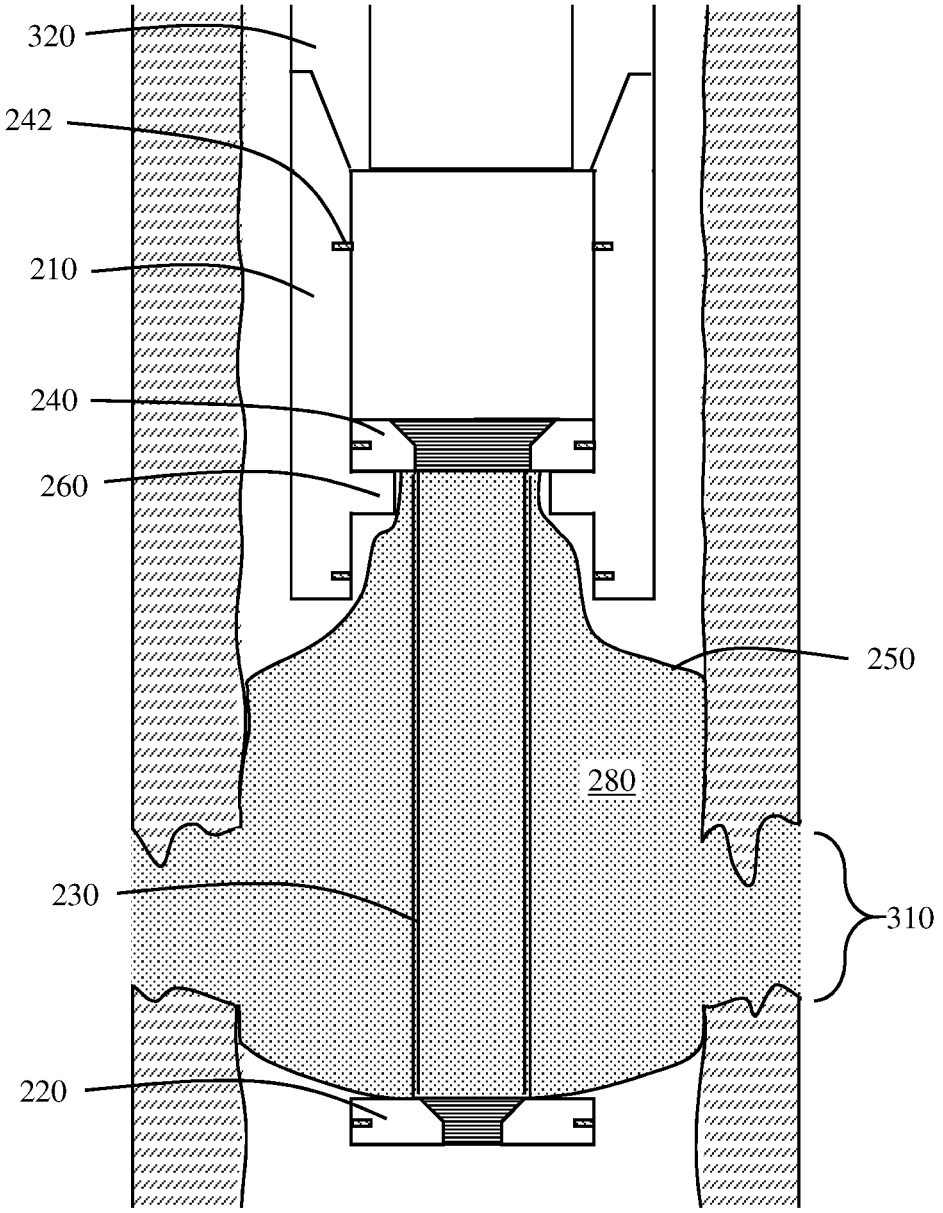

As shown in FIG. 7, after the cap ring 240 has been sealed, pressure may be exerted on the sealed cap ring 240 (e.g., by pumping a fluid through the drill string) until the shear pin(s) 242 shear, and the sealed cap ring 240 is detached from the tubular body 210. When detached from the tubular body 210, the sealed cap ring 240 may land on the seat 260, which may hold the sealed cap ring 240 in an axial position above the section of the wellbore to be sealed. The drop of the sealed cap ring 240 may also lower the attached sealed base ring 220 (attached via the flexible ties 230) by a corresponding drop distance, such that the sealed base ring 220 may be positioned below the section of the wellbore to be sealed. In such manner, the sealed base ring 220 and sealed cap ring 240 may provide a seal axially below and above, respectively, the section of the wellbore comprising the lost circulation zone 310.

The fabric strip 250 may act as a flexible wall extending between the upper and lower seals to hold the plugging material 280 within the section of the wellbore comprising the lost circulation zone 310. The excess length of the fabric strip 250 compared to the flexible ties 230 allows the fabric strip 250 to balloon radially outward, allowing the plugging material 280 to flow toward and at least partially within the formation in the lost circulation zone 310. Depending on the size of the openings in the lost circulation zone 310, e.g., crack/fissure sizes, the fabric strip 250 (and plugging material 280 therein) may partially fill the openings. For example, in total lost circulation zones having fracture sizes of about an inch or greater, the fabric 250 and plugging material 280 contained therein may fill a depth into the fractures.

A holding time to hold the plugging material 280 within the sealed section of the wellbore until it hardens or cures may be determined based on the type of plugging material 280 being used. For example, a holding time for a cement plugging material may be determined as the amount of time for the cement to harden under the pressure and temperature conditions around the sealed section of the wellbore. Holding times for holding the plugging material 280 within the sealed section of the wellbore may range, for example, from greater than 1 hour, greater than 2 hours, or greater than 4 hours, to less than 10 hours, less than 1 day, or less than 2 days.

After the holding time for the plugging material 280 to harden or cure, the running tool 320 (or other drill string connecting piece) may be disconnected from the plug injection tool 200. In some embodiments, a non-drillable portion of the plug injection tool may be disconnected from a drillable portion of the plug injection tool including the upper seal (e.g., sealed cap ring 240). For example, in some embodiments, the seat 260 may be made of a drillable material (e.g., steel) and detachably fixed within the tubular body 210 (e.g., by at least one shear pin having a greater shear strength than the shear pins 242, 222 used to hold the cap and base rings 240, 220). After the plugging material 280 is hardened/cured within the section of the wellbore containing the lost circulation zone 310, the tubular body 210 may be pulled up to disconnect the seat 260. The body 210 may then be removed from the wellbore, thereby leaving the sealed cap ring 240 and seat 260 above the sealed section of the wellbore. In some embodiments, the body 210 may be made of a drillable material and left with the seals for a subsequent drill out step. Depending on which components are made of drillable material, a release tool may be selected to release the non-drillable material components from the drillable material components.

After the plug injection tool 200 is removed from the wellbore, the sealed section of the wellbore may be drilled through. In embodiments where a drillable portion of the plug injection tool may remain with the solidified plugging material (and a non-drillable portion of the plug injection tool is removed), a subsequent drilling trip may drill through the remaining drillable portion of the plug injection tool and the sealed section of the wellbore.

Figure 8:
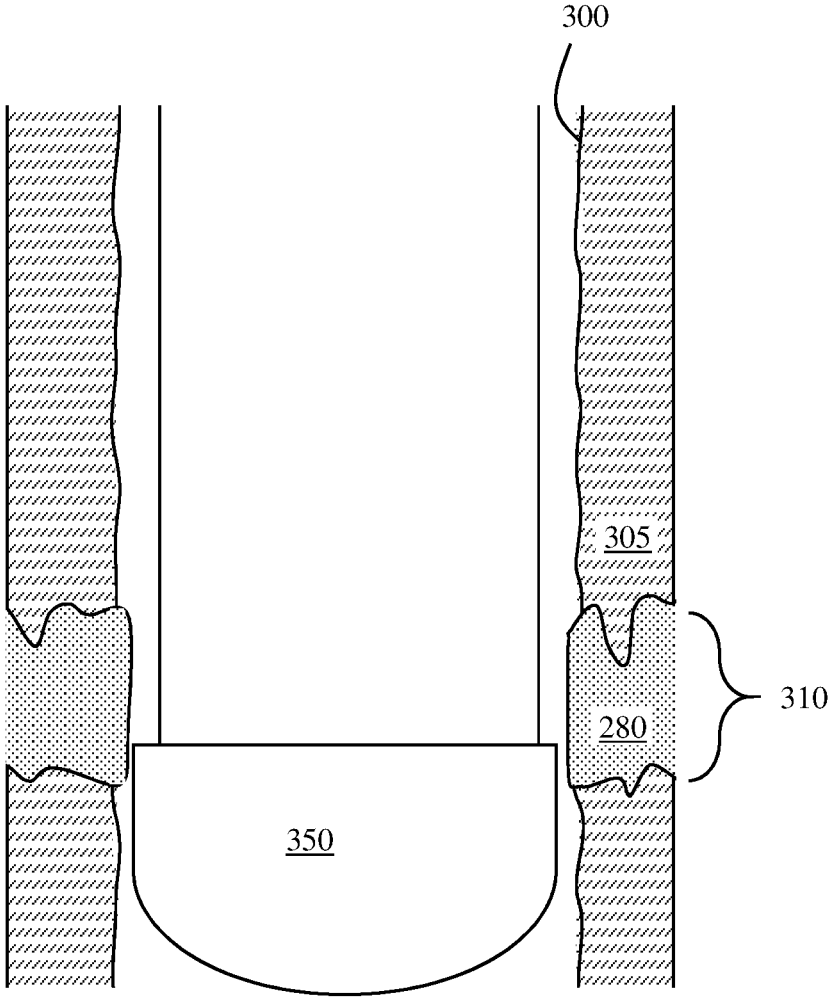

As shown in FIG. 8, the sealed section of the wellbore 300 may be drilled through using a bit 350 having substantially the same diameter as the bit used to originally drill the section of the wellbore, such that the wellbore 300 may have a substantially consistent inner diameter, and the solidified plugging material 280 may remain within the undrilled openings in the formation 305 of the lost circulation zone 310.

Other configurations of a plug injection tool may be used to provide a seal axially above and below a lost circulation zone in a wellbore in order to hold a plugging material within the sealed section of the wellbore containing the lost circulation zone. For example, in some embodiments, a plug injection tool may have actuated release mechanisms to release a sealed base ring and/or cap ring. In some embodiments, the flexible tie(s) and fabric strip(s) in a plug injection tool may be attached at an upper attachment point to a non-movable element inside the plug injection tool (e.g., along an inner wall of the tubular body or on a cap ring fixedly attached inside the tubular body).

Figure 9:
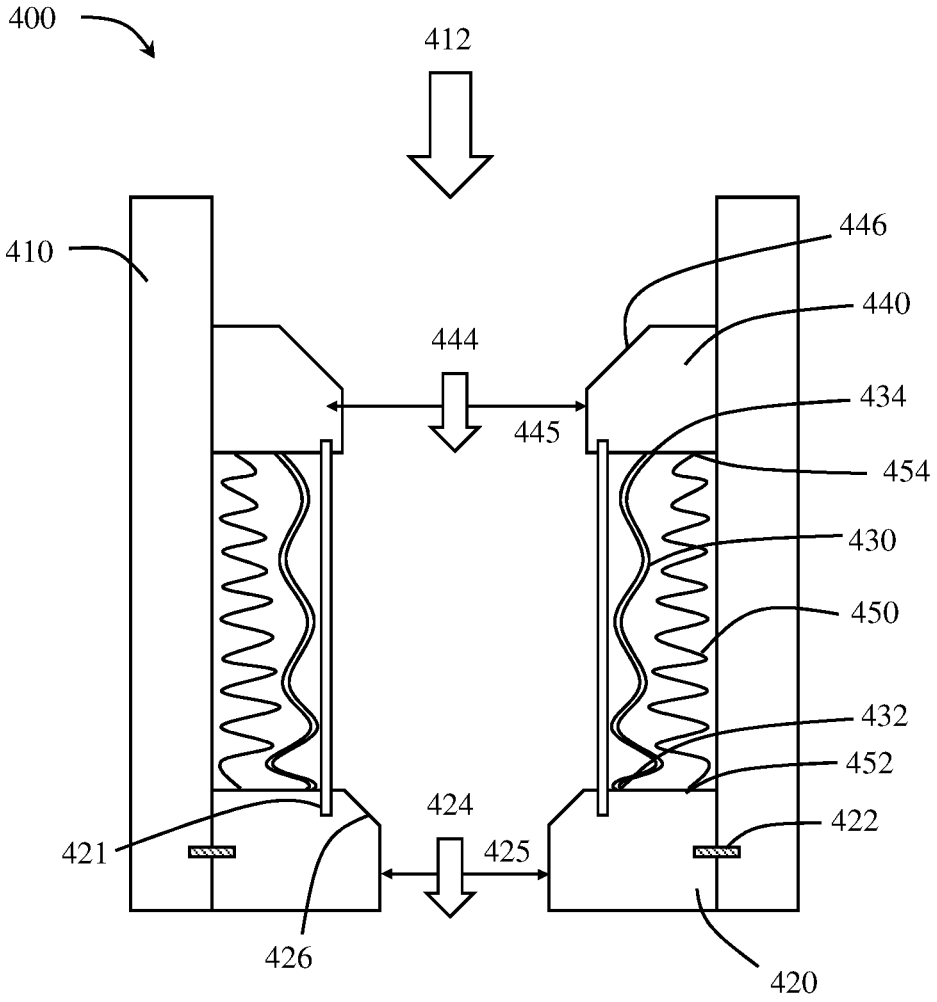
FIG. 9 shows a cross-sectional view of a plug injection tool according to embodiments of the present disclosure.

FIG. 9 shows an example of another plug injection tool 400 that may be used to provide a seal axially below and above a selected section of a wellbore containing a lost circulation zone. The plug injection tool 400 may include a base ring 420 removably attached inside a bottom end of a generally tubular body 410 using one or more shear pins 422. The base ring 420 may include a through hole 424 extending through the radial center of the base ring 420. A base seat 426 may be formed around the upper end of the through hole 424, having a surface sloping outwardly from the through hole 424, where the inner diameter of the base seat 426 gradually increases from the inner diameter 425 of the through hole 424.

At least one flexible tie 430 may be held within the tubular body 410 by attaching one axial end to a lower attachment point 432 on the base ring 420 and an opposite axial end to an upper attachment point 434 in an upper end of the tubular body 410. The flexible tie upper attachment point 434 may be around a cap ring 440 that is fixedly attached (e.g., welded) inside the upper end of the tubular body 410. In some embodiments, a cap ring may be integrally formed with the tubular body 410, where the cap ring 440 forms a varying inner diameter through the tubular body 410. In some embodiments, a flexible tie upper attachment point 434 may be provided directly to the inner surface of the tubular body 410.

The cap ring 440 may have a through hole 444 extending through the radial center of the cap ring 440 and having an inner diameter 445 larger than the inner diameter 425 of the base ring 420. A cap seat 446 may be formed by an outwardly sloping surface extending from the through hole 444 to an upper surface of the cap ring 440.

A fabric strip 450 may be held radially between the flexible tie(s) 430 and the tubular body 410 by attaching one axial end of the fabric strip 450 at a lower attachment point 452 to the base ring 420 and an opposite axial end of the fabric strip 450 at an upper attachment point 454 to the cap ring 440. In some embodiments, a fabric strip upper attachment point 454 may be directly to the inside of the tubular body 410.

Figure 10:
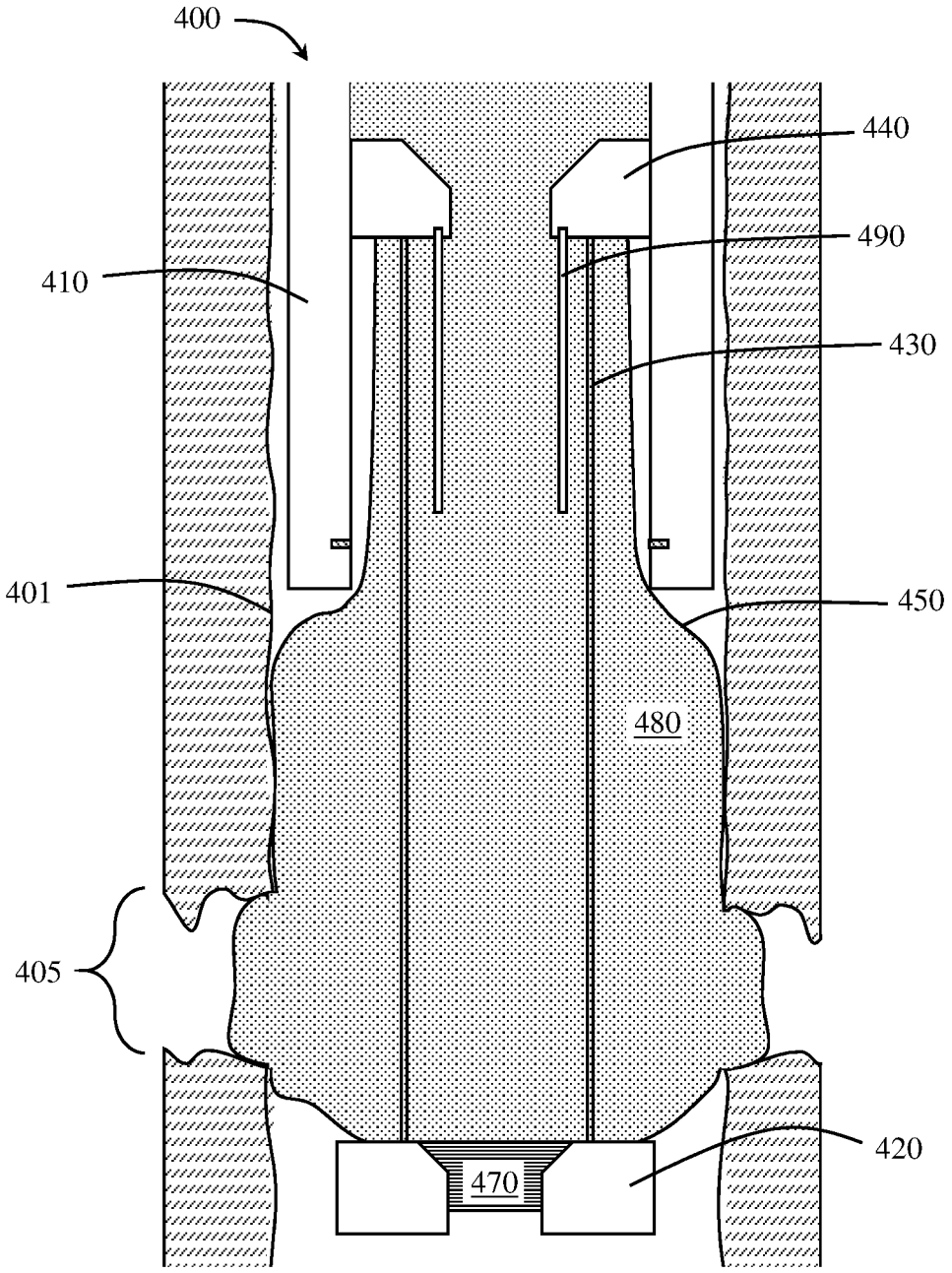
FIG. 10 shows an example of the plug injection tool of FIG. 9 in operation downhole.

In plug injection tools 400 having flexible tie and fabric strip upper attachment points on a fixedly attached cap ring 440 (or directly to an inner surface in the tubular body 410), the flexible ties 430 may have a length that is greater than the axial distance of the section of the wellbore to be sealed. For example, as shown in FIG. 10, in operation, the plug injection tool 400 may have a first sealing element 470 dropped on the base seat 426 to plug and seal the base ring 420. Plugging material 480 may then be pumped into the plug injection tool 400 until the pressure build up on the sealed base ring 420 shears the shear pins 422, and the sealed base ring 420 falls from the tubular body 410. The flexible ties 430 may have a length that is long enough to hold the sealed base ring 420 below the section (containing lost circulation zone 405) of the wellbore to be sealed from their upper attachment points inside the upper end of the tubular body 410.

In some embodiments, a housing 490 may be provided within the tubular body 410 extending between the base ring 420 and cap ring 440 and radially interior to the flexible ties 430 and fabric strip 450. The housing 490 may retain the flexible ties 430 and fabric strip 450 within an annular space between the housing 490 and the tubular body 410 until the base ring 420 is sealed and detached from the tubular body 410, at which point, the flexible ties 430 and fabric strip 450 may be axially extended with the detached sealed base ring 420 out of the housing 490.

In some embodiments, a housing 490 may be a thin wall extending circumferentially around a flow passage 412 formed axially through the plug injection tool 400. One axial end of the housing 490 may remain fixed to the cap ring 440 while an opposite axial end of the housing 490 may be removable from the base ring 420. For example, an upper axial end of the housing 490 may be welded to the cap ring 440 and a lower axial end of the housing 490 may be set within a groove 421 formed around an upper surface of the base ring 420. When the base ring 420 is sealed and detached from the tubular body 410, the lower axial end of the housing 490 may be separated from the groove 421 in the base ring 420.

Other configurations of a housing may be used to retain the flexible ties and fabric strip proximate an inner surface of the tubular body 410 prior to releasing the flexible ties and fabric strip with detachment of a sealed base ring 420. For example, a housing may be fixedly attached to the base ring 420 and removably set within a cap ring 440 (such that the housing drops with the sealed base ring 420 once the sealed base ring 420 is detached). Additionally, other types of temporary retention mechanisms may be used to retain the flexible ties and fabric strip proximate the inner surface of the tubular body 410 prior to releasing the flexible ties and fabric strip with detachment of the sealed base ring 420.

FIG. 10 shows an example of the plug injection tool 400 in operation, where a first sealing element 470 was positioned to plug the base ring 420, and plugging material 480 was pumped into the plug injection tool 400 until the pressure from the plugging material 480 detached the sealed base ring 420 from the tool body 410. Upon detaching from the tool body 410, the sealed base ring 420 may drop away from the housing 490 to an axial position in the wellbore 401 below the lost circulation zone 405. The fabric strip 450 is longer than the flexible ties 430 holding the sealed base ring 420, such that there is enough fabric for the plugging material 480 to push the fabric strip 450 radially outward toward the wellbore wall 401. By holding the plug injection tool 400 (and thus upper axial ends of the flexible ties and fabric strip via the upper attachment points) axially above the lost circulation zone 405, and providing long enough flexible ties 430 to have the sealed base ring 420 positioned axially below the lost circulation zone 405, the radial expansion of the fabric strip 450 may cover the lost circulation zone 405. Further, depending on the size of the openings in the formation along the lost circulation zone 405, the fabric strip 450 may extend at least partially into the lost circulation zone 405, thereby at least partially filling the openings with plugging material 480, such as exemplified in FIG. 10. After the plugging material 480 has hardened, the wellbore may be re-drilled, leaving some of the fabric 450 and hardened plugging material 480 filling and/or covering the openings in the formation of the lost circulation zone 405.

Figure 11:
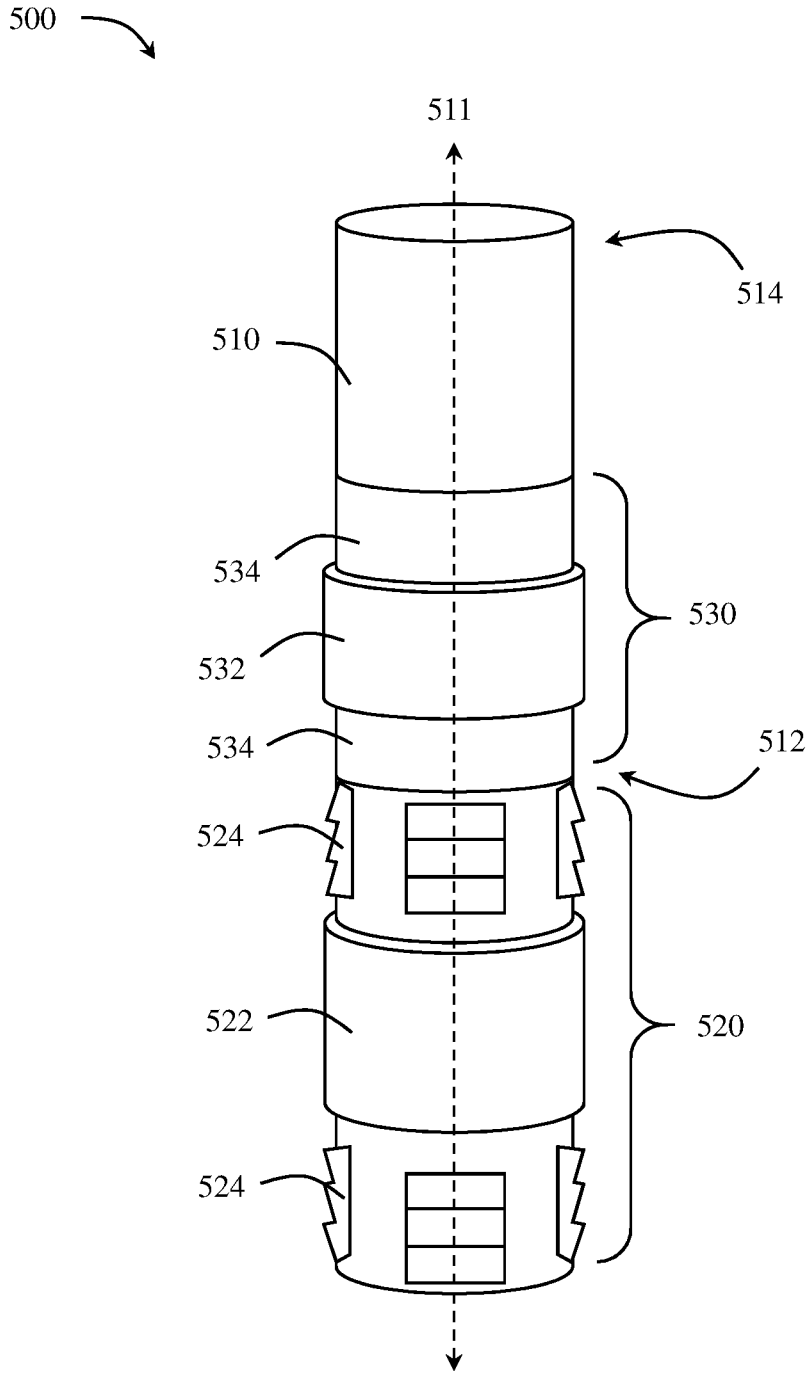
FIG. 11 shows a plug injection tool according to embodiments of the present disclosure.

FIG. 11 shows another example of a plug injection tool 500 according to embodiments of the present disclosure. The plug injection tool 500 may have a first sealing element 520 connected to a bottom axial end 512 of a tubular body 510, wherein the first sealing element 520 and the tubular body 510 are axially adjacent to each other and coaxially aligned along longitudinal axis 511. A second sealing element 530 may be provided around an outer surface of the tubular body 510 and above the first sealing element 520. In some embodiments, the second sealing element 530 may be connected to a bottom axial end of the tubular body 510, and the first sealing element 510 may be connected to an axial end of the second sealing element 530 opposite the tubular body 510. An upper axial end 514 (opposite the bottom axial end 512) of the tubular body 510 may be attached to a running tool (not shown), for example, by a threaded connection.

The first sealing element 520 may include an axially compressible and radially expandable packer element 522, which may be designed to have an outer diameter approximately equal to or slightly greater than the inner diameter of the wellbore when the packer element 522 is radially expanded in order to contact and seal the wellbore. The packer element 522 may be axially compressed, for example, using a set of slips 524 positioned at opposite axial ends of the packer element 522. The slips 524 at one axial end may be activated to radially expand and engage the wellbore wall, and the packer element 522 may be axially compressed toward the set slips 524. The slips at the opposite axial end may then be activated to radially expand and engage the wellbore wall, thereby holding the packer element 522 in the axially compressed, radially expanded position. Activation of the slips 524 may be achieved using known techniques, such as hydraulic activation or using a ball drop. Further, other configurations of the slips and/or sealing elements 520 may be used for setting a packer element 522 to seal a wellbore, as is known in the art, for example, as done with downhole bridge plugs.

Similarly, the second sealing element 530 may include an axially compressible and radially expandable packer element 532, which may be axially compressed by compressing elements 534 on opposite axial ends of the packer element 532. The elements 534 used to axially compress the packer element 532 may have, for example, slips or other gripping surface to contact and grip the wellbore wall.

Different known types of wellbore plugs or seals may be used as a first sealing element to seal an axially lower boundary of the section of the wellbore to be sealed (containing a lost circulation zone) and as a second sealing element to seal an axially upper boundary of the section of the wellbore to be sealed.

Figure 12:
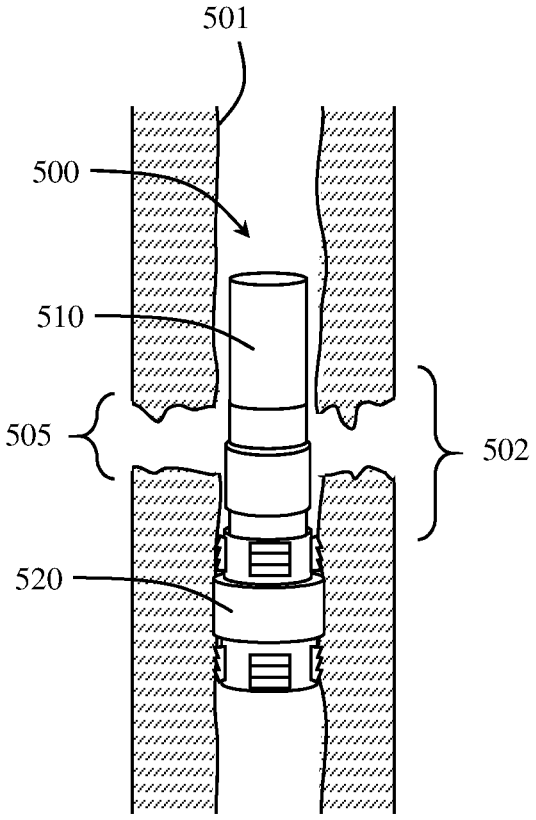
FIGS. 12 and 13 show operational steps in a method of using the plug injection tool of FIG. 11 according to embodiments of the present disclosure.
Figure 13:
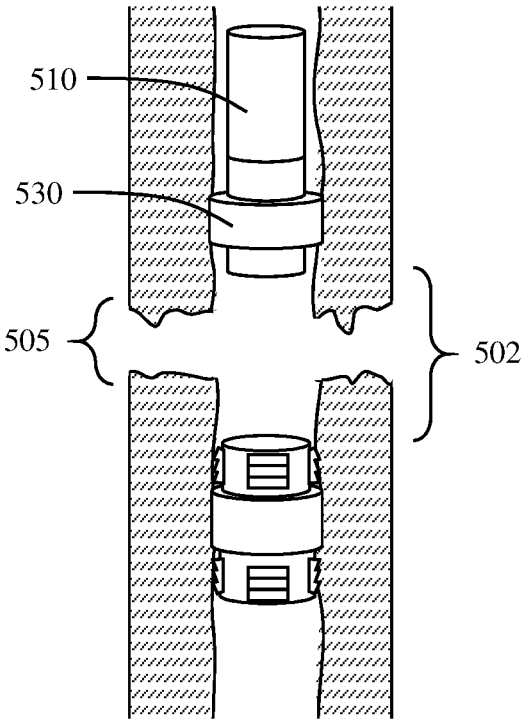

As shown in FIGS. 12 and 13, the plug injection tool 500 may be used to seal a section 502 of a wellbore 501 containing a lost circulation zone 505 by sending the plug injection tool 500 to a downhole location proximate the selected section 502 of the wellbore 501, and setting the first sealing element 520 below the section 502 of the wellbore 501 (shown in FIG. 12). The first sealing element 520 may be set below the section 502 of the wellbore by sending the first sealing element 520 to a position axially below the section 502 of the wellbore, activating the packer element 522 of first sealing element 520 to radially expand to contact an entire inner diameter of the wellbore 501 wall, and disconnecting the first sealing element 520 from the tubular body 510.

Once the first sealing element 520 is set and disconnected from the plug injection tool 500, the plug injection tool 500 may be moved to a position in the wellbore axially above the section 502 of the wellbore to be sealed. The second sealing element 530 may then be set above the section 502 of the wellbore (shown in FIG. 13) by activating the packer element 532 of the second sealing element 530 to radially expand to contact the entire inner diameter of the wellbore wall.

When the first and second sealing elements 520, 530 are set axially below and above the section 502 of the wellbore, a plugging material may be pumped through the plug injection tool body and between the first and second sealing elements 520, 530. The plugging material may be sealed between the first and second sealing elements 520, 530 until it solidifies.

According to embodiments of the present disclosure, portions of the plug injection tool 500 may be drillable. For example, at least a portion of the tubular body 510, the first sealing element 520, and the second sealing element 530 may be made of drillable materials, e.g., brittle materials, such as cast iron, aluminum, or plastic, or relatively softer materials than a drill bit, such as steel or polymer composites. In some embodiments, the first and second sealing elements 520, 530 may be drillable packer assemblies or similar assemblies such as bridge plugs, which may be set axially below and above the section 502 of the wellbore. A drillable packer assembly may be removed from the wellbore by drilling through it in a subsequent drilling step.

After plugging material has been pumped between the upper and lower positioned sealing elements, the drill string may be disconnected from the drillable portions of the plug injection tool 500. For example, the second sealing element 530 may be disconnected from the tool body 510, and the tool body 510 may be brought back to the surface of the well with the drill string. In some embodiments, where the tool body 510 is made of a drillable material, the drill string may be disconnected from the tool body 510 and brought back to the surface of the well, and the tool body 510 and connected second sealing element 530 may remain in the wellbore. A subsequent drilling step may then drill through the portions of the plug injection tool 500 remaining in the wellbore and the solidified plugging material.

Embodiments such as described with reference to FIGS. 11-13, where a fabric is not used, may be suitable for sealing a section 502 of a wellbore around a lost circulation zone 505 resulting in seepage (e.g., less than 3 $m^3$/hr) or partial lost returns (e.g., greater than 3 $m^3$/hr, but some fluid is still returned), whereas fabric may be provided on tools according to embodiments of the present disclosure for sealing sections of a wellbore around a lost circulation zone resulting in total lost returns (where no fluid returns). In some embodiments, plug injection tools using a fabric according to embodiments of the present disclosure may also be used to seal lost circulation zones resulting in partial lost returns.

Figure 14:
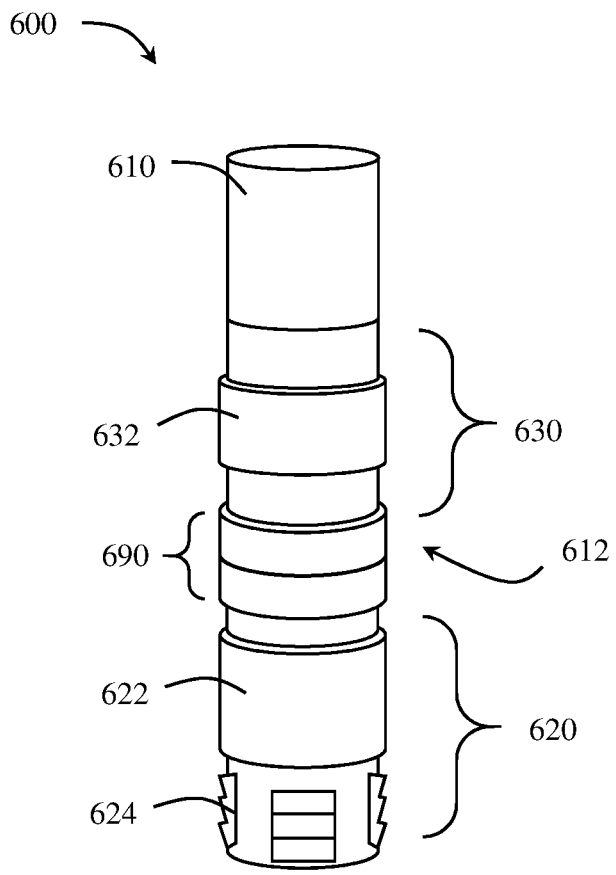
FIG. 14 shows a plug injection tool according to embodiments of the present disclosure.

FIG. 14 shows another example of a plug injection tool 600 having a first sealing element 620 connected to a bottom axial end 612 of a tubular body 610, wherein the first sealing element 620 and the tubular body 610 are axially adjacent to each other and coaxially aligned. A second sealing element 630 may be provided on the tubular body 610 above the first sealing element 620.

The first sealing element 620 may include an axially compressible and radially expandable packer element 622, which when radially expanded, may have an outer diameter approximately equal to or slightly greater than the inner diameter of the wellbore in which the tool 600 is to be disposed in order to contact and seal the wellbore. The packer element 622 may be axially compressed, for example, using a set of slips 624, gripping surface, or other known activation method. Similarly, the second sealing element 630 may include an axially compressible and radially expandable packer element 632, which when radially expanded, may have an outer diameter approximately equal to or slightly greater than the inner diameter of the wellbore.

The plug injection tool 600 may further include a housing 690 disposed around an outer perimeter of the tool 600. The housing 690 may surround and protect a fabric strip 650 (shown in FIG. 16) stored within an annulus formed between the housing 690 and tool body 610 and connected at opposite axial ends to the first and second sealing elements 620, 630. The housing 690 may be attached to at least one of the first sealing element 620, the second sealing element 630, and the tool body 610. The housing 690 may further be configured to release the fabric strip 650 upon setting the first sealing element 620. For example, a housing may have at least one gate through which the fabric strip may extend through, or the housing may be formed of multiple parts that come apart to release the fabric strip.

Figure 15:
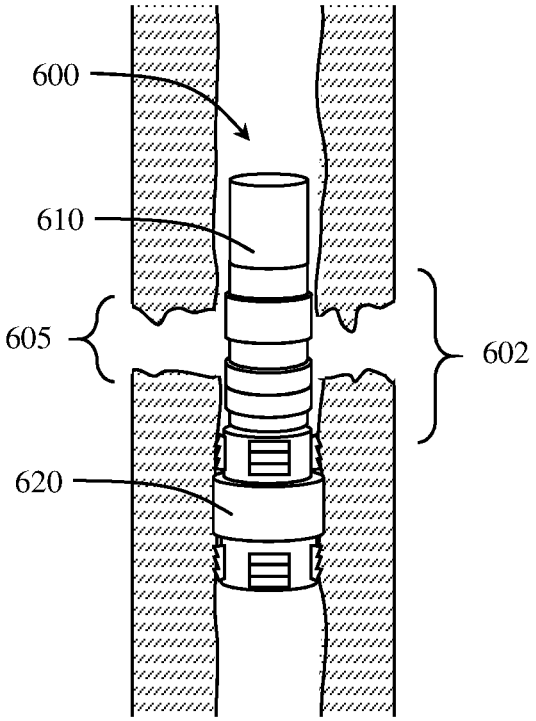
FIGS. 15 and 16 show operational steps in a method of using the plug injection tool of FIG. 14 according to embodiments of the present disclosure.
Figure 16:
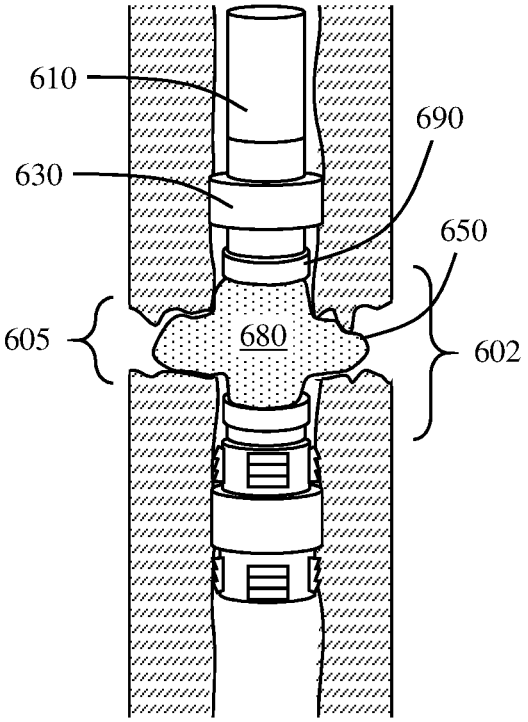

FIGS. 15 and 16 show an example of using the plug injection tool 600 to seal a section 602 of a wellbore 601 containing a lost circulation zone 605. As shown in FIG. 15, the plug injection tool 600 may be sent to a downhole location proximate the selected section 602 of the wellbore 601, such that the first sealing element 620 is in a position axially below the section 602 of the wellbore. The packer element 622 of the first sealing element 620 may then be activated to radially expand to contact and seal an entire inner diameter of the wellbore 601 wall, thereby setting the first sealing element 620 below the section 602 of the wellbore 601. The first sealing element 620 may then be disconnected from the tubular body 610.

As shown in FIG. 16, once the first sealing element 620 is set and disconnected from the plug injection tool 600, the plug injection tool 600 may be moved to a position in the wellbore axially above the section 602 of the wellbore to be sealed. As the plug injection tool 600 is moved apart from the set first sealing element 620, the housing 690 may be opened to allow the fabric strip 650 stored therein to be released.

The second sealing element 630 may then be set above the section 602 of the wellbore by activating the packer element 632 of the second sealing element 630 to radially expand to contact and seal the entire inner diameter of the wellbore wall.

When the first and second sealing elements 620, 630 are set below and above the section 602 of the wellbore, a plugging material 680 may be pumped through the plug injection tool body 610 and between the first and second sealing elements 620, 630 and within the fabric strip 650.

The plugging material 680 may be held in the sealed section 602 of the wellbore until the plugging material 680 solidifies.

The drill string (including running tool) may be disconnected from the plug injection tool 600 and brought back to the surface of the well. The components of the plug injection tool 600 remaining in the well and the solidified plugging material 680 may subsequently be drilled through, leaving the lost circulation zone 605 plugged.

Lost circulation has been a major challenge in drilling operations by causing partial or total loss of drilling fluids. Lost circulation also represents financial loss due to the non-productive time and extra cost on the drilling fluid to maintain the fluid level in the annulus between the drill string and wellbore. In severe lost circulation cases, the flowing of mud in the loss zone and resulting pressure drop on the open formation may compromise the well control and cause catastrophic results. By using methods and apparatuses of the present disclosure, severe lost circulation may be reduced or stopped, for example, by sealing an area around the lost circulation zone and holding a plugging material within the sealed area until the plugging material is activated or solidified and effectively plugs the lost circulation zone.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method of plugging a section of a wellbore wall, comprising:

sending a plug injection tool to a downhole location proximate the section of the wellbore wall;

setting a first seal on the plug injection tool below the section of the wellbore wall;

moving a second seal on the plug injection tool and the first seal an axial distance apart from each other after the first seal is set;

setting the second seal above the section of the wellbore wall;

pumping a plugging material between the first and second seals; and holding the plugging material between the first and second seals until the plugging material solidifies between the first and second seals.

2. The method of claim 1, wherein the plug injection tool comprises a tubular body, where the first seal is connected at a bottom axial end of the tubular body, and the second seal is connected around the tubular body axially above the first seal.

3. The method of claim 2, wherein setting the first seal below the section of the wellbore wall comprises:

sending the first seal to a position axially below the section of the wellbore wall;

activating the first seal to radially expand to contact an entire inner diameter of the wellbore wall; and disconnecting the first seal from the tubular body.

4. The method of claim 3, wherein after disconnecting the first seal from the tubular body, setting the second seal above the section of the wellbore wall comprises:

moving the plug injection tool to position the second seal axially above the section of the wellbore wall; and activating the second seal to radially expand to contact the entire inner diameter of the wellbore wall;

wherein the plugging material is pumped between the first and second seal after the first and second seals are set.

5. The method of claim 1, wherein the plug injection tool comprises:

a base ring fixed inside a bottom end of a tubular body using at least one shear pin;

at least one flexible tie connected at one end to the base ring and at an opposite end to a first attachment point inside an upper end of the tubular body; and a fabric strip connected to and extending between the base ring and a second attachment point inside the upper end of the tubular body.

6. The method of claim 5, wherein setting the first seal below the section of the wellbore wall comprises:

setting the first seal within a through hole in the base ring to seal the base ring; and pumping the plugging material into a cavity formed by the tubular body and the sealed base ring until pressure from the plugging material forces the sealed base ring to shear from the tubular body;

wherein the sheared sealed base ring remains connected to the tubular body by the at least one flexible tie, the at least one flexible tie having a length that holds the sealed base ring below the tubular body.

7. The method of claim 6, wherein the fabric strip is longer than the at least one flexible tie, such that after pumping the plugging material shears the sealed base ring from the tubular body, the plugging material is continued to be pumped to fill and expand the fabric strip into the section of the wellbore wall.

8. The method of claim 5, wherein setting the second seal above the section of the wellbore wall comprises:

moving the tubular body to a position above the section of the wellbore wall; and setting the second seal within a second through hole formed inside the tubular body, the second through hole having a diameter larger than the through hole of the base ring;

wherein the second seal is set after pumping the plugging material.

9. The method of claim 8, wherein the second through hole is formed through a cap ring fixed within the tubular body by at least one shear pin, and wherein after setting the second seal within the second through hole, fluid is pumped into the tubular body to force the cap ring to shear from the tubular body and drop a distance to a seat formed inside the tubular body.

10. The method of claim 1, further comprising disconnecting the plug injection tool from a running tool.

11. The method of claim 10, further comprising drilling through the plug injection tool and the solidified plugging material.

12. A method of plugging a section of a wellbore wall, comprising:

sending a plug injection tool to a downhole location proximate the section of the wellbore wall;

wherein after the plug injection tool is sent to the downhole location, the method further comprises:

setting a first seal on the plug injection tool below the section of the wellbore wall;

moving a second seal on the plug injection tool and the first seal an axial distance apart from each other;

setting the second seal above the section of the wellbore wall after setting the first seal below the section of the wellbore wall;

pumping a plugging material between the first and second seals after setting the first seal and after setting the second seal; and holding the plugging material between the first and second seals until the plugging material solidifies between the first and second seals.

13. The method of claim 12, wherein setting the first seal below the section of the wellbore wall comprises:

sending the first seal to a position axially below the section of the wellbore wall;

activating the first seal to radially expand to contact an entire inner diameter of the wellbore wall; and disconnecting the first seal from the plug injection tool.

14. The method of claim 12, wherein setting the second seal above the section of the wellbore wall comprises:

moving the plug injection tool to position the second seal axially above the section of the wellbore wall; and activating the second seal to radially expand to contact the entire inner diameter of the wellbore wall.

15. A method of plugging a section of a wellbore wall, comprising:

sending a plug injection tool to a downhole location proximate the section of the wellbore wall;

setting a first seal on the plug injection tool;

moving the first seal an axial distance apart from a second seal on the plug injection tool;

moving the first seal below the section of the wellbore wall;

setting the second seal above the section of the wellbore wall;

pumping a plugging material between the first and second seals after setting the first seal and before setting the second seal; and holding the plugging material between the first and second seals until the plugging material solidifies between the first and second seals.

16. The method of claim 15, wherein setting the first seal comprises:

landing the first seal on a through hole in a base ring of the plug injection tool to seal the base ring; and pumping the plugging material into the plug injection tool with the sealed base ring until pressure from the plugging material forces the sealed base ring to shear from the tubular body;

wherein the sheared sealed base ring remains connected to the tubular body by the at least one flexible tie, the at least one flexible tie having a length that holds the sealed base ring below the tubular body.

17. The method of claim 15, wherein setting the second seal comprises landing the second seal on a hole formed through a cap ring on the plug injection tool to seal the cap ring.

18. The method of claim 15, further comprising, after setting the second seal, exerting a pressure on the second seal to move both the set first seal and the seat second seal, wherein the set first seal is moved to a position below the section of the wellbore wall, and wherein the set second seal is moved to a position above the section of the wellbore wall.

* * * * *